US005655812A

United States Patent [19]

Albecker, III

[11] Patent Number: 5,655,812

[45] Date of Patent: Aug. 12, 1997

[54] UPHOLSTERY SYSTEM FOR CHAIRS

[76] Inventor: Walter J. Albecker, III, 838 S. May, Chicago, Ill. 60607

[21] Appl. No.: 363,753

[22] Filed: Dec. 23, 1994

Related U.S. Application Data

[63] Continuation-in-part of Ser. No. 899,750, Jun. 17, 1992, Pat. No. 5,425,567.

[51] Int. Cl.[6] ..... A47C 1/14

[52] U.S. Cl. ..... 297/218.2; 297/218.1; 297/440.11; 297/452.59

[58] Field of Search ..... 297/218.1–218.5, 297/219.1, 226, 440.11, 452.59; 5/633, 634, 653, 654

[56] References Cited

U.S. PATENT DOCUMENTS

| | | | |
|---|---|---|---|
| 3,680,916 | 8/1972 | Gilbert et al. | 297/440.11 |
| 3,801,154 | 4/1974 | Hultquist et al. | 297/218.1 |
| 4,408,802 | 10/1983 | Adomeit et al. | 297/218.1 X |
| 4,588,227 | 5/1986 | Austin | 297/440.11 X |
| 4,834,451 | 5/1989 | Meunier et al. | 297/218.2 |
| 4,865,383 | 9/1989 | Sbaragli et al. | 297/218.2 |
| 5,478,134 | 12/1995 | Bernard et al. | 297/218.1 |

FOREIGN PATENT DOCUMENTS

| | | | |
|---|---|---|---|
| 2542180 | 9/1984 | France | 297/219.1 |

OTHER PUBLICATIONS

Siesta from Westrofa—Design from Scandanavia No. 8, p. 74.

Esko Pajamies Design from Scandanavia No. 8 p. 40.

Charles Eames—"EA124" Twentieth Century Furniture Design p. 192.

*Primary Examiner*—Peter R. Brown

[57] ABSTRACT

Upholstery systems for use on chair frames, comprising a support sheet (24) sewn to finished upholstery fabric (30) with a cushion (26) inside the envelope formed by the support sheet (24) and the finished upholstery material (30). The support sheet (24) has ends that are suitable for attaching to cross members (70 & 71) in a manner that will securely hold the upholstery system in place. Additionally, inside the upholstery system there is a securing rod (23) that can be positioned on the support sheet (24) to secure the upholstery system in a desirable position between the sides (72) of a chair frame in a manner that enables the upholstery system to be stretched in a preferred shape. The securing rod 23 is secured to either the sides of the frame (72) or to a cross member (20A) that is secured to the sides (72) of a chair frame. The upholstery system eliminates elements traditionally found in upholstery systems such as fabric on the back of cushions which is normally used in addition to a support sheet (24). Additionally, the method is suitable for upholstering somewhat irregularly shaped wooden frames, without having to cover up most of the wood, and it works it in a relatively simple manner. Also disclosed are frames particularly suited for the upholstery system to be used on.

21 Claims, 6 Drawing Sheets

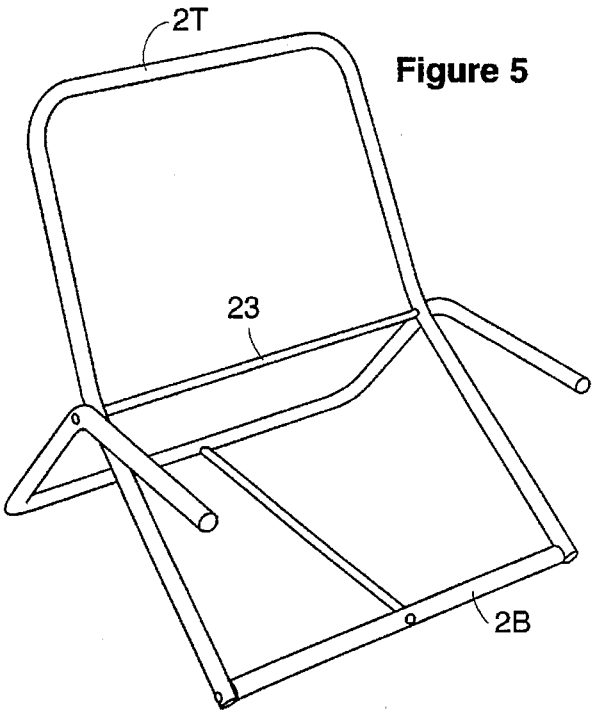
Figure 5
Figure 6B
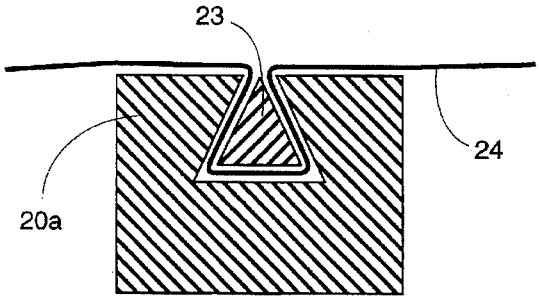
Figure 6A
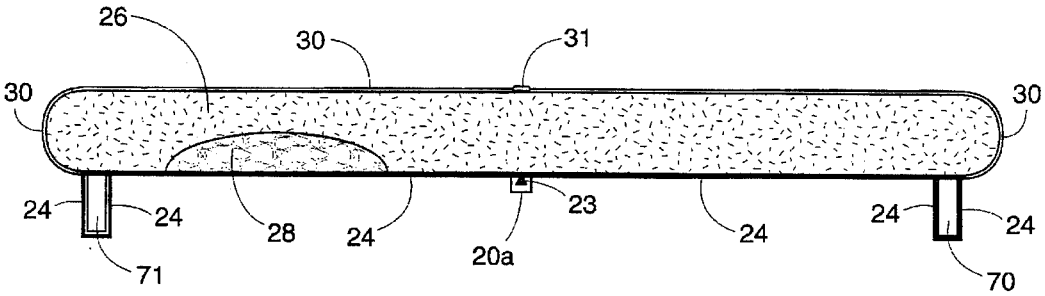

UPHOLSTERY SYSTEM FOR CHAIRS

BACKGROUND—CROSS REFERENCE TO RELATED APPLICATION

This application is a continuation-in-part of application Ser. No. 07/899,750, filed Jun. 17, 1992, now U.S. Pat. No. 5,425,567, granted Jun. 20, 1995, which application is incorporated by reference herein, in its entirety. The basics of the present invention were disclosed in PCT application number PCT/US/93/05848 filed Jun. 17, 1993, which application is incorporated by reference herein in it's entirety.

BACKGROUND—FIELD OF INVENTION

This invention relates to upholstered furniture, and specifically to upholstery systems that include a support sheet, a cushion, and upholstery around the cushion.

BACKGROUND—DISCUSSION OF PRIOR ART

In most chairs or couches, the upholstery system is made of some sort of support system such as springs, webbing, or canvas, and on top of this, there is a cushion that has been upholstered on all sides and the top and bottom. In instances where the support system is a solid sheet such as canvas, normally the canvas is secured to what would be the left side and right side of a chair frames, and occasionally in addition it is secured to the top and bottom or front and back of the frame. In developing the leisure chairs that are shown in the drawings, I had a need to develop an upholstery system where the solid support sheet was secured primarily to the top and bottom or front and back as opposed to the left and right sides. The reason I tried to do it this way, is that it is difficult to wrap a solid sheet of fabric around a portion of a wooden frame that has an obtuse angle on it. Additionally, in seeking to make the chair as economically as possible, I sought ways to eliminate one layer of fabric around the cushion. The result is the following.

OBJECTS AND ADVANTAGES OF INVENTION

Accordingly, several objects and advantages of the present invention are:

(a) To provide an upholstery system that is optimally supportive at the right places.

(b) To provide an upholstery system that is very simple and economical to manufacture.

(c) To provide an upholstery system that can be used with a wood frame in such a way that it leaves most of the wood showing.

(d) To provide an upholstery system that can be used for furniture that has one or more turns in the sides of the frame portion that the upholstery is attached to.

Still further objects and advantages will become apparent from a consideration of the ensuing description and drawings.

BRIEF DESCRIPTION OF THE DRAWINGS

In the drawings, closely related figures have the same number, but different alphabetic suffixes.

FIG. 5 shows an isometric view of a chair frame that might be used with the embodiment shown in FIG. 4.

FIG. 6A is a side view of a cushion and upholstery assembly for use on embodiments such as shown in FIGS. 6C, 6D, 6E and 6F.

FIG. 6B is a cross section view of the cross bar at obtuse angle shown in FIGS. 6C and 6D showing how the support sheet is attached.

DESCRIPTION OF INVENTION

Figure 1A:
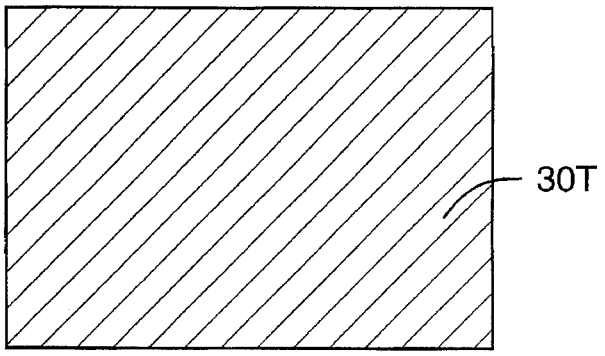
FIGS. 1A–D show the major components of a preferred embodiment of upholstery system before being assembled.
Figure 1B:
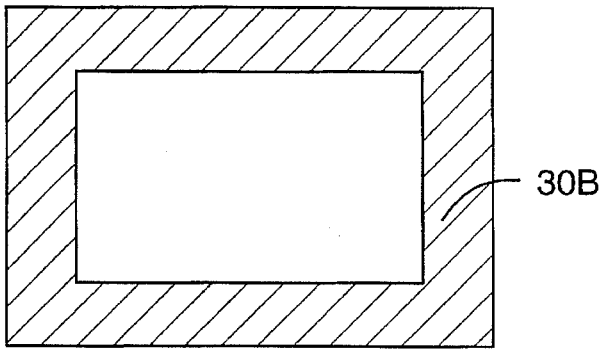
Figure 1C:
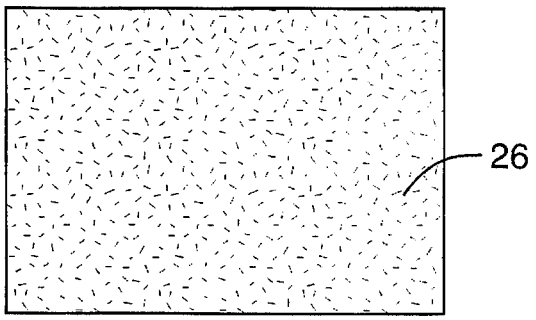
Figure 1D:
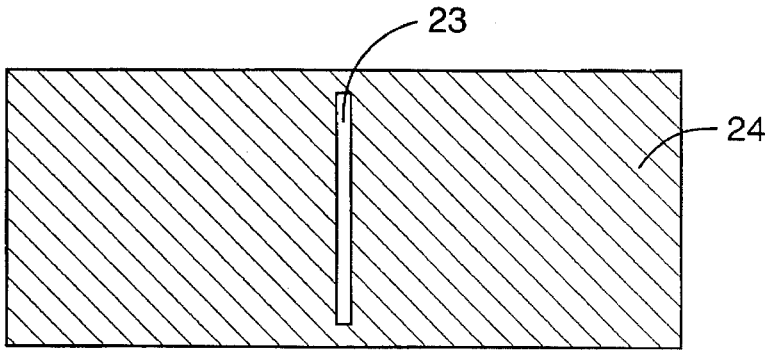

FIGS. 1A–D show the major components of a preferred embodiment of the upholstery system before being assembled. FIG. 1A shows a top view of the top portion of an upholstery fabric 30T such as velvet, leather, or any suitable upholstery fabric. It is just a piece of fabric cut into a rectangle. FIG. 1B is a top view of the bottom portion 30B of the same kind of material as 30T, probably the same size, but with a rectangle in the middle removed. Note that any of these pieces can be made of one solid piece, or from a number of smaller pieces joined together. FIG. 1C is a top view of a rectangular polyurethane foam cushion 26. FIG. 1D is a top view of a support sheet 24 which could be made of any sheet of material that can be used to support the weight of a human body, and could be canvas, nylon, flexible plastic, etc. This material is shown in a simple rectangle, but longer than the top upholstery 30T and probably not as wide. Shown on the support sheet 24 is a securing rod 23, which can be made from a piece of hardwood in a size of about ¾" thick by 1" wide. The securing rod 23 can be stapled to the support sheet 24 to hold it in position.

Figure 2:
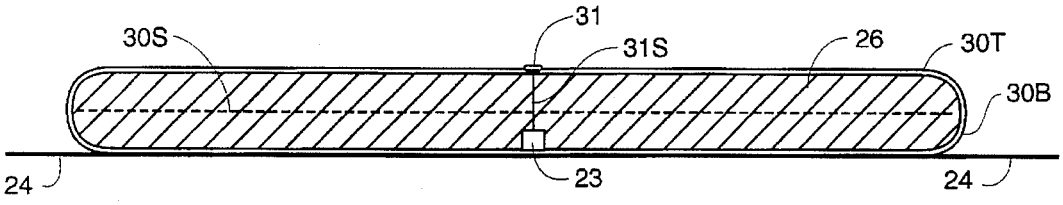
FIG. 2 shows the the components shown in FIG. 1 assembled to form a preferred embodiment of the present invention.

FIG. 2 shows a side view of the components shown in FIG. 1 assembled to form a preferred embodiment of the present invention. To make this, the bottom upholstery material 30B is placed over the support sheet 24, and sewn to the support sheet 24 around the inner perimeter of the bottom upholstery material 30B. Next, the top upholstery material 30T is sewn to the bottom upholstery material 30 to form a seam at their outer perimeters on 3 sides. At this point, the upholstery system is like a pillowcase, and the cushion 26 is put inside, and then the final side of the "pillowcase" is sewn shut with the cushion 26 inside. The seam 30S joining the top upholstery material 30T to the bottom upholstery material 30B is shown. Also the securing rod 23 is shown in the drawing, though it cannot really be seen because it is inside the upholstery. Also shown, is a button 31 attached to the securing rod 23. This button 31 can be attached in any of a number of common ways known to upholsterers. One method would be to drill a hole in the securing rod 23 and support sheet 24, pull the string 31S through the securing rod 23 and then staple the string 31S through the support sheet 24 to the securing rod 23. Of course there can be any number of buttons 31 used, and other upholstery means can also be used.

Figure 3:
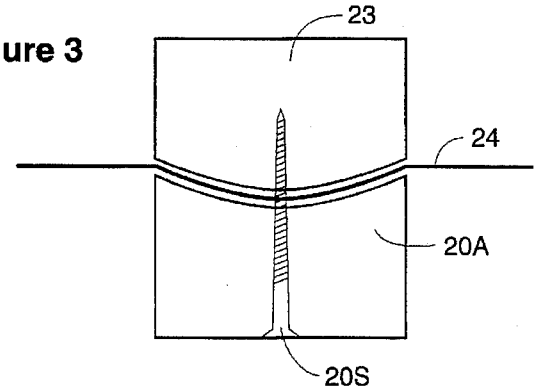
FIG. 3 shows a close up of a cutaway detail of the securing rod shown in FIG. 2, with other components as it would be assembled on a chair.

FIG. 3 shows a close up of a cutaway detail of the securing rod shown in FIG. 2, with other components as it would be assembled on a chair. In the drawing, the securing rod 23 is attached to a cross bar 20A with a screw 20S. The support sheet 24 is shown between the securing rod 23 and the cross bar 20A. The securing rod 23 and cross bar 20A can be made of any of a number of complementary shapes, including rounded as shown, tongue and groove, flat, etc. It is also quite possible to have non-complementary shapes such as having one member rounded and the other flat. The possibilities are very wide. This is a cross section showing only one screw 20S, but in reality there would probably be two or three appropriately spaced screws.

Figure 4:
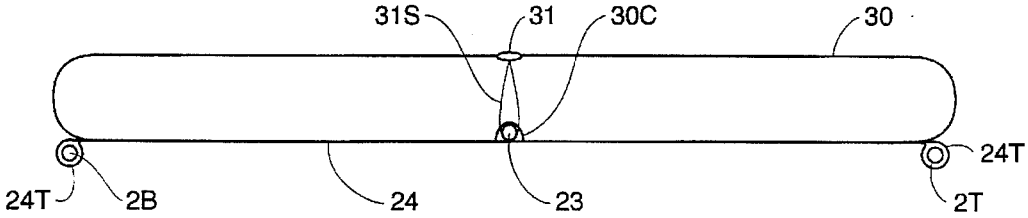
FIG. 4 shows a side view of a preferred embodiment that could be ideally be used for a chair frame made of tubular steel or another application where a one piece securing rod is preferred.

FIG. 4 shows a side view of a preferred embodiment that could be ideally be used for a chair frame made of tubular steel or another application where a one piece securing rod 23 is preferred. In the drawing, there is a cutaway 30C in the upholstery 30 to allow the securing rod 23 to extend all the way through the upholstery system. The button string 31S could be looped around the securing rod 23 as shown. The bottom cross member 2B and top cross member 2T are each shown around a tube 24T sewn into the ends of the support sheet 24.

FIG. 5 shows an isometric view of a chair frame that might be used with the embodiment shown in FIG. 4. In the drawing, the cross members 2B, 2T, and the securing rod 23 are shown.

Figure 6C:
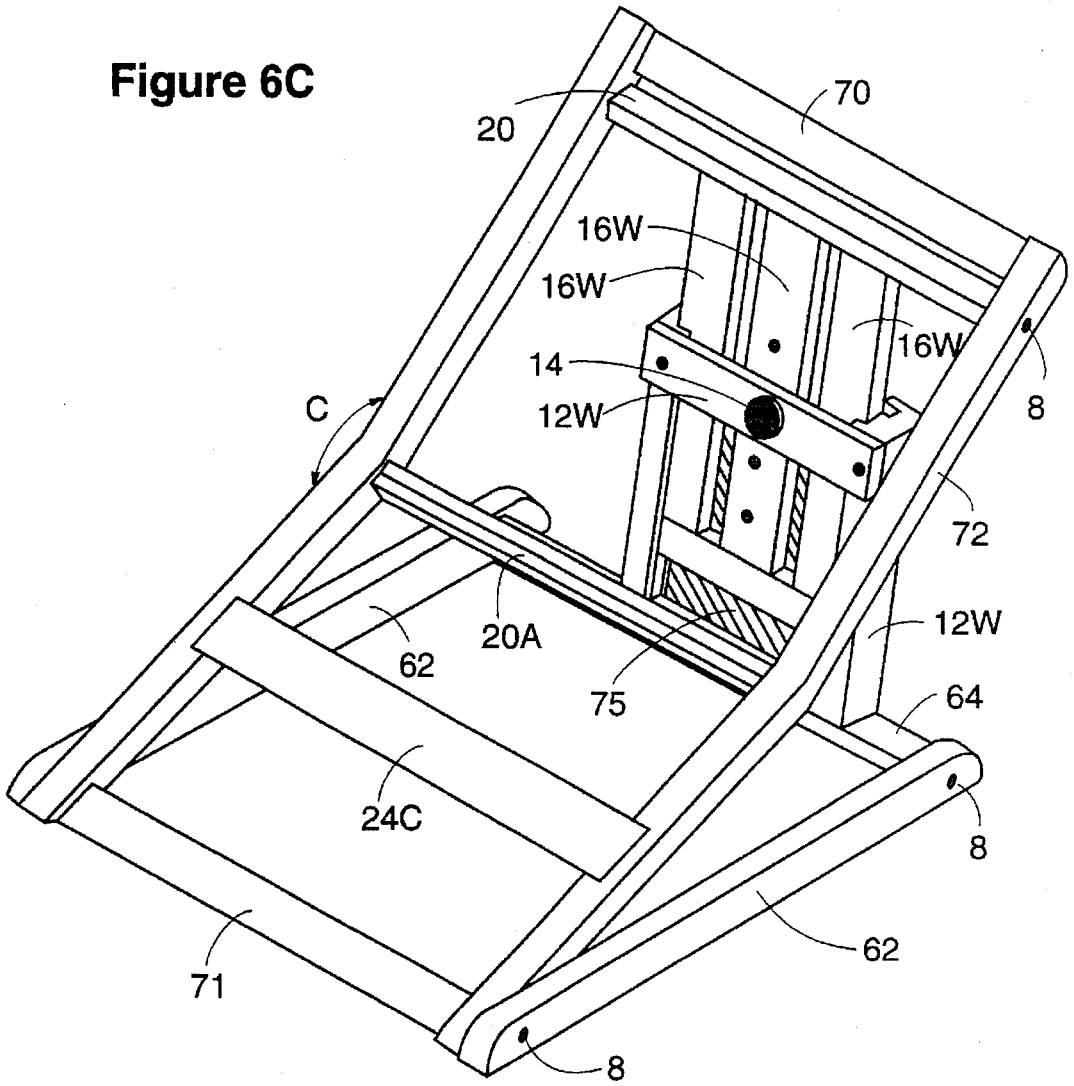
FIG. 6C is an isometric view of a support frame of an embodiment of a wooden frame including an upper and lower telescoping adjustment mechanism that could be used with the present invention.
Figure 6D:
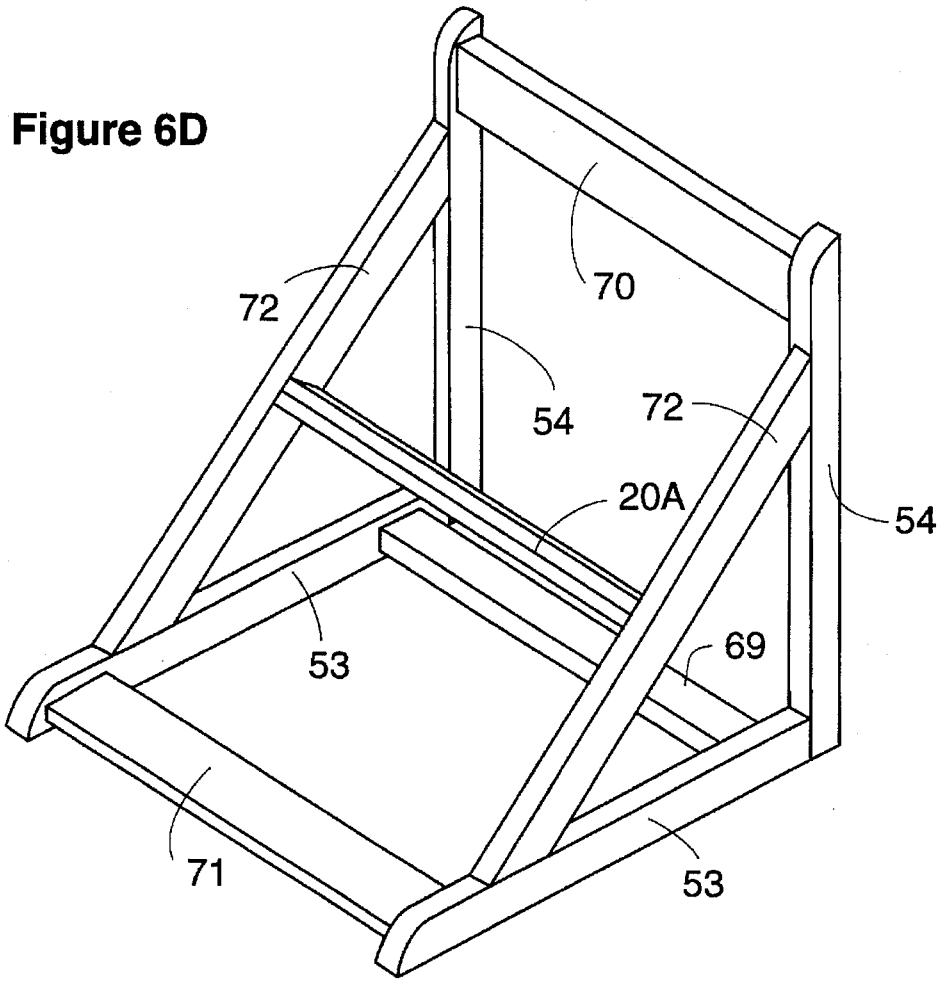
FIG. 6D is an isometric view of a support frame of an embodiment of the present invention with straight slope frame side pieces.
Figure 6E:
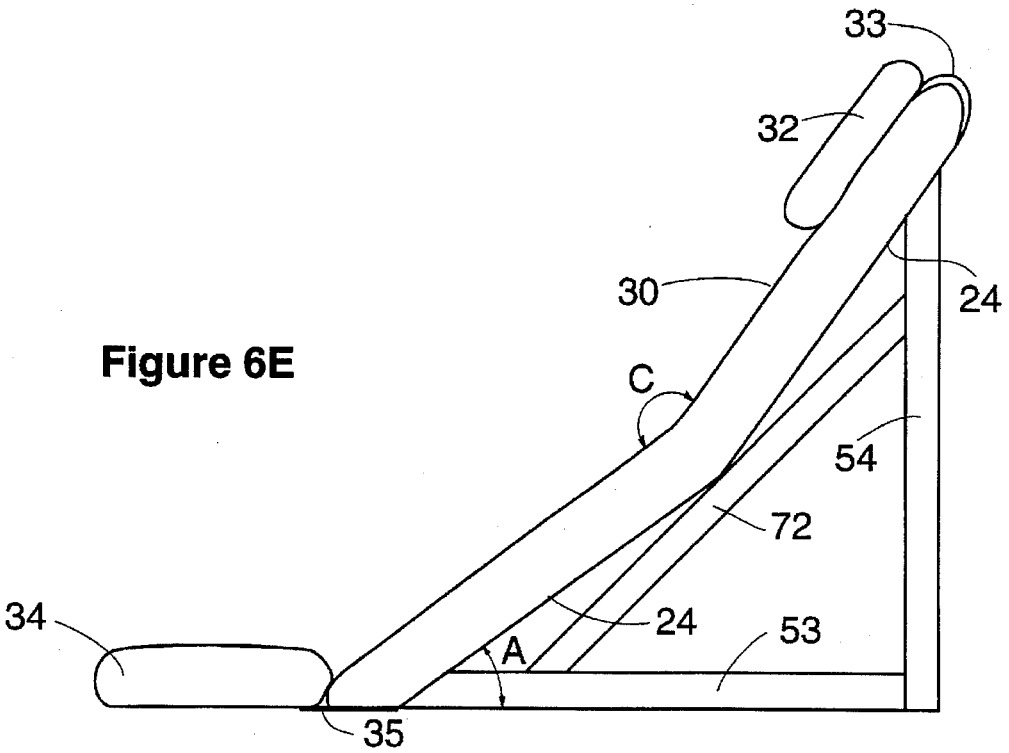
FIG. 6E is a side view of the embodiment shown in FIG. 6D with support sheet and upholstery attached.

FIG. 6A is a side view of the upholstery system used on the embodiments shown in FIGS. 6C, 6D and 6E. In a preferred embodiment, the upholstery is completed with the support sheet securing rod 23 attached to the support sheet 24. The support sheet 24 is then sewn with the top upholstery 30 in such a way that the cushion 26 and lumbar support 28 will be enveloped in the support sheet 24 and the top upholstery 30. The support sheet 24 has to be sewn to the top upholstery 30 in such a way that there will be about 6" of the support sheet 24 material extending beyond the seam joining the top upholstery 30 to the support sheet 24. This 6" will be attached to the front base cross member 71 and the upper cross member 70 as shown with staples or a similar fastening method. Next the cross bar at obtuse angle **20*a* with the channel in it will be slipped over the support sheet securing rod 23 that has been attached to the support sheet 24 and is now between the support sheet 24 and the cushion. A skilled upholsterer should be able to understand how this could be done, and know other techniques such as using buttons 31 to secure the cushion in the proper way. See FIG. 6B for more specifics on cross bar at obtuse angle 20*a* and the support sheet securing rod 23**.

FIG. 6B is a cross section view of the cross bar at obtuse angle **20*a* shown in FIGS. 6C, 6D, and 6E. The cross bar 20*a* has a generally triangular channel at the top, in the center. The channel can be routed in with a dovetail router bit. Inside the channel is a support sheet securing rod 23 which is a triangular shaped rod made of probably the same kind of wood as the cross bar 20*a*. Shown between the channel in the cross bar 20*a* and the support sheet securing rod 23 is the frame cover/support sheet 24. The frame cover/support sheet 24 would be made of canvas, or another type of strong fabric. The support sheet securing rod 23 would be no longer than the distance between the two slope frame side pieces 72 shown in FIGS. 6C and 6D. The support sheet 24 can be attached to the support sheet securing rod 23 with staples or a similar means to hold it in place temporarily, and it must be placed in the proper position. Positioning will be determined by where the support sheet will line up with the obtuse cross member 20*a* when it is properly attached on a frame. At the proper time, the support sheet securing rod 23 with the support sheet 24** attached will be slipped into the channel in the crossbar at obtuse angle. This is very similar to the technique used to fasten the canvas seats in many director's chairs. Also, similar to director's chairs, the channel could be round instead of triangular, and a wooden dowel could be used.

FIG. 6C is an isometric view of another generally wedge shaped frame of an embodiment of the present invention which can be made almost entirely of wood, and which can be adjusted by using a telescoping adjustment assembly. The lower support piece comprises both the pivoting lower cross member 64 and the wooden lower telescoping piece **12*w*, and this is preferably assembled before attaching to the side of base supports 62. The pivoting lower cross member 64 is attached to the wooden lower telescoping piece 12*w* with screws. The wooden lower telescoping piece 12*w* has a front, a back, and two sides. The sides in a preferred embodiment are made of a hardwood about 2" deep×1" thick×11" high, and have two lengthwise grooves in them. The one groove is about ⅜" wide and ¼" deep for gluing and holding in place the front or face board 15 of the lower telescoping piece 12*w*. In the drawing, the part of the face board 15 that can be seen from this perspective is the shaded area, and this is only a portion of the back side of the face board 15 and an upper corner toward the right side of the drawing. The face board 15 in a preferred embodiment is ⅜" thick, 8" wide and 11" high. It could be plywood, or could be made of the same wood that the rest of the frame is made out of. The other groove in the sides serves as a track for the wooden upper telescoping assembly 16*w* to slide up and down in. The back consists of a board connecting the two sides, using screws. Since the back is not easily seen, it is not necessary that it be bigger than necessary to hold the securing knob and threaded base 14. In a preferred embodiment, the back is made from a piece of hardwood about ¾" thick, 2" high, and 10" wide. On the back of the wooden lower telescoping piece 12*w*, there is also a safety catch 17 which can be used to prevent the frame from collapsing if the securing knob 14 was not tightened and someone lifted the chair from behind so that the wooden upper telescoping assembly 16*w* came out of the track in the wooden lower telescoping piece 12*w*. The safety catch 17 could be a spring loaded catch that would protrude in such a way that the upper telescoping assembly 16*w* couldn't be raised out of the track without depressing the spring loaded catch 17**.

The wooden upper telescoping assembly **16*w* is made of one or more vertical pieces, in the drawing 3 vertical pieces are shown, which are connected to a lower horizontal piece and the pivoting cross bar 20. The joints between the vertical pieces and the lower horizontal piece and the pivoting cross bar 20 in a preferred embodiment were made using mortise and tenon joinery and screws. Other methods can be employed. In a situation where only 1 vertical piece is used, the lower horizontal piece could be eliminated. In the center piece of the wooden upper telescoping assembly 16*w*, there are a number of holes which correspond to securing knob with threaded stud 14**. These are to prevent the telescoping mechanism from slipping when the securing knob is locked in a position with a corresponding hole.

The sides of the base support 62 are attached at the rear to the pivoting lower cross member 64. In a preferred embodiment, this connection is made by putting a round tenon on the ends of the pivoting lower cross member 64 that is about ¼" long and about 1" in diameter. This round tenon is put into a corresponding ¼" deep hole in the side of the base support 62 which has had a flat metal washer inserted before assembly. This is then joined by a screw 8 which is tightened to a point that enables the pivoting lower cross member to pivot, but with very little play. There are other ways of making the pivoting joint including a rotary hinge or just using a screw and washer without the round tenon or corresponding hole. The pivoting cross bar 20 can be joined to the slope frame side pieces 72 using the same principles as were used to join the pivoting lower cross member 64 and the side of base support 62.

The slope frame side pieces 72 are pivotally joined to the sides of the base support 62 with a screw 8. A washer is used between the base 62 and slope 72 side pieces to prevent rubbing, and the hole for the screw in the base side pieces 62 will be slightly larger than the screw 8 used, to permit the pivoting.

The front base cross member 71, the cross bar at obtuse angle 20*a*, and the upper cross member 70 are joined to the slope side frame pieces using mortise and tenon or other suitable joinery methods. The support sheet and upholstery for this frame is installed in a manner very similar to that used in FIG. 6A, 6B, and FIG. 6E described below. One notable difference is that for this embodiment, webbing 24*c* can be stretched across the lower portion under where the lumbar support goes, to provide extra support under the support surface.

This frame folds very compactly for storage and shipping. And it should be understood that this embodiment can be made of a variety of other materials suggested for other embodiments. It can be made in a variety of ways, for example the telescoping pieces can be made in many different sizes and shapes to give a variety of looks.

FIG. 6D is an isometric view of another generally wedge shaped frame of an embodiment of the present invention made of wood with straight slope side pieces 72. There can be a definite advantage in making the slope side pieces straight as opposed to angled, because they can be cut very economically from wood, and there is very little waste. In the drawing, the base support member 53 is joined to the vertical support member 54 at about a 90 degree angle. The slope frame side piece 72 is joined to the base support member 53 and the vertical support 54 as shown. On both the base support member 53 and the vertical support 54 the tips at the longest points of the slope frame side piece 72 are about 4" from the points at which the base support member 53 and vertical support 54 begin their tapering angle at the ends opposite where they meet at 90 degrees. The reason for this is so that when the support sheet is put in place it will be stretched to provide the obtuse angle C shown in FIG. 6E. When a matched set of slope frame side pieces 72, the base support members 53, and the vertical supports 54 are joined together, they form the side units. The side units are assembled with the four cross members, but not until the upholstery is attached to the appropriate cross members. The upper cross member 70 and the front base cross member 71 provide stability to the frame and are the parts that the ends of support sheet 24 will be attached to. The cross bar at obtuse angle 20*a* is used to stretch the support sheet at the obtuse angle C as shown in FIG. 6E. The cross bar at obtuse angle 20*a* cannot be installed until the support sheet is attached to it. The rear base cross member 69 is used to provide additional stability. All of the cross members and the components that make up the side units, will be appropriately joined with mortise and tenon joints, doweled joints, finger joints, etc. and/or mechanical fasteners such as screws. This particular embodiment is particularly suited for shipping ready to assemble with the side units made in a factory, and with the cross members with the support sheet, cushions and upholstery attached to be installed by the consumer. It should be noted that another version very similar to this embodiment could be made using an angled slope piece similar to 72 used in FIG. 6C but using all the other parts of this embodiment. Also, instead of using a fabric type support sheet 24, another type like plywood or pressed wood could be used. And of course, this embodiment could be made of other products other than wood similar to those mentioned for other embodiments.

FIG. 6E is a side view of the embodiment shown in FIG. 6D with the support sheet 24, cushions, and upholstery attached 30. In a preferred embodiment the upholstery is completed as shown in FIG. 6A, and then the cross members are assembled starting with the front base member 71 and the upper cross member 70. For easier assembly, if mortise and tenon joinery is being used, the tenons on the cross bar at obtuse angle 20*a* should be shorter than the others. This will enable the assembler to have the unit partially together before having to stretch the support sheet 24. And the support sheet should be stretched somewhat to give a firm support. When the upholstery is put on, the obtuse angle C will be similar to that on other embodiments. Also, shown on the drawing are the seat cushion 34, the seat cushion straps 35, the head pillow 32, the straps for head pillow 33, and the angle of the lower portion of the backrest/leisure chair with respect to the floor A. All of these are similar to those described with other embodiments.

Figure 6F:
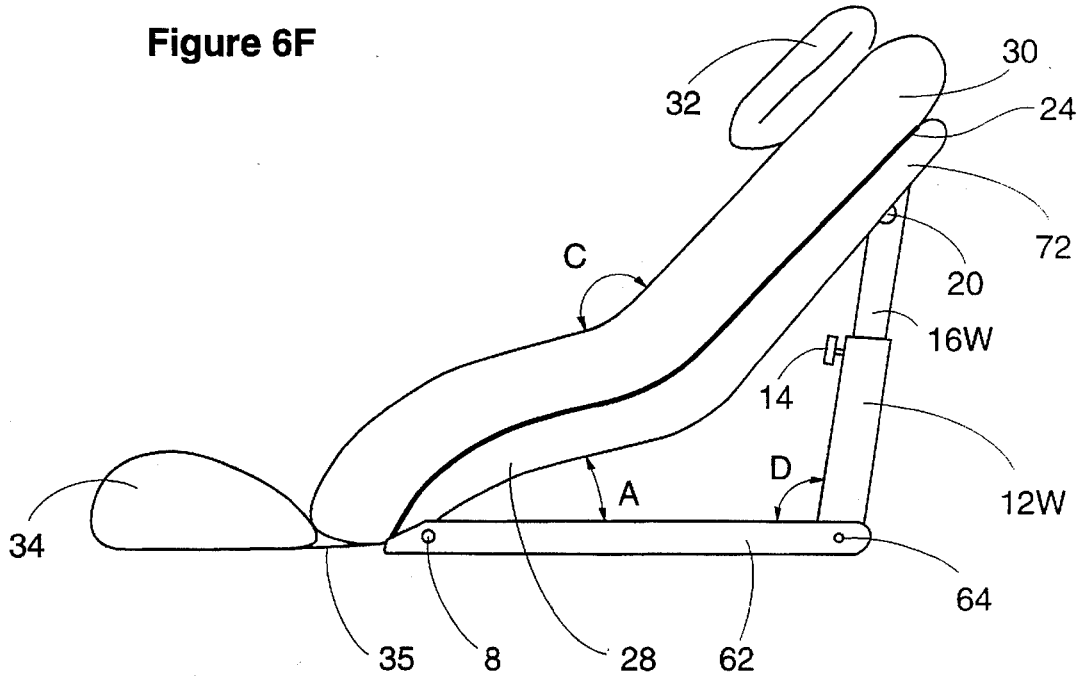
FIG. 6F is a side view of an embodiment similar to the one shown in FIG. 6C, but with a curved lower portion.

FIG. 6F shows a side view of an adaptation of the frame shown in FIG. 6C with the lower portion of the frame curved to provide a lumbar support without the internal lumbar support shown in FIG. 6A. This frame can be used with the upholstery system in this invention, because this embodiment has the cross webbing 24*c* as shown in FIG. 6C that will guide the upholstery in following the curved contour. If desired, the webbing 24*c* could be made wider than shown in FIG. 6C or more than one strip of webbing 24*c* could be used in the area of the curve.

CONCLUSIONS, RAMIFICATIONS, AND SCOPE OF INVENTION

Although my above description contains many specificities, these should not be construed as limiting the scope of the invention, but merely as providing illustrations of the presently preferred embodiments of this invention. Many other variations are possible. This invention can be made a number of ways, with a wide variety of materials, it can be made with a number of accessories as part of it or to used be with it, and the principles of this invention can be applied to a number of other uses.

For example, the cross members can be made with a curve to provide a concave shape to the cushion and support sheet. The backrests/leisure chairs can be made of a great variety of materials. The frames can be made of wood, metal tubing, other structural metal, plastics, fiberglass, resin, glue laminated wood, etc. The support sheet can be made of fabric, leather, plastic sheets, etc. The cushion can be made of a variety of materials including cotton, feathers, polyurethane foam, polyester fill, dacron fill, shredded foam, etc.

Other methods, materials, and techniques that can be applied to making upholstery systems of invention are known or will be known in the industry relating to this invention. The principles of this invention can be applied to futon designs, to chaise type lounges or other type lounges, regular upright type chairs, chaise lounges and couches.

It should also be very clearly pointed out that many of the possibilities shown and/or described in the embodiments herein are interchangeable between embodiments. Accordingly, the scope of the invention should be determined not by the embodiments illustrated, but by the appended claims and their legal equivalents.

I claim:

1. A cushioned upholstery system in combination with a chair frame, said upholstery system comprising:

(a) a support sheet capable of supporting the weight of a seated occupant further having ends suitable for securing the upholstery system to a chair frame;

(b) a cushion body;

(c) an upholstery fabric sewn to the support sheet, in a manner that together the support sheet and upholstery fabric form an envelope around the cushion;

(d) at least one securing rod between the cushion and the support sheet for securing the upholstery system to said chair frame at least at one point between the ends of the support sheet;

(e) said chair frame including at least one cross bar placed next to the securing rod on the opposite side of the support sheet for holding the securing rod in position; and (f) an attachment means fastening the securing rod and the cross bar.

2. The cushioned upholstery system of claim 1 wherein the chair frame has at least one strip of webbing positioned underneath the support sheet for providing extra support for the support sheet at the position of the webbing when the support sheet and webbing are attached to the chair frame.

3. The cushioned upholstery system of claim 1 wherein the chair frame has two symmetrical sides, and wherein the side members are curved.

4. The cushioned upholstery system of claim 1 further having buttons on the surface of the upholstery fabric with an attachment means extending from the upholstery fabric through the cushion to the securing rod, and wherein the buttons are secured to the securing rod with the attachment means.

5. The cushioned upholstery system of claim 1 further having buttons on the surface of the upholstery fabric with an attachment means extending from the upholstery fabric through the cushion and support sheet, and wherein the buttons are secured generally near the securing rod with the attachment means.

6. The cushioned upholstery system of claim 1 wherein the chair frame includes an upper cross member and a lower cross member, and wherein the support sheet ends of the upholstery system are in a tubular shape adapted for securing the upholstery system to the chair frame by slipping the tubular ends of the support sheet over the upper and lower cross members.

7. The cushioned upholstery system of claim 1 wherein the attachment means comprises mechanical fasteners.

8. The cushioned upholstery system of claim 1 wherein the attachment means comprises dovetail type interlocking joint.

9. The cushioned upholstery system of claim 1 wherein the securing rod and cross bar have complementary shapes at the point of contact.

10. A cushioned upholstery system adapted to be attached to a chair frame comprising:

(a) a support sheet capable of supporting the weight of a seated occupant further having ends suitable for securing the upholstery system to the chair frame;

(b) a cushion body;

(c) an upholstery fabric sewn to the support sheet, in a manner that together the support sheet and upholstery fabric form an envelope around the cushion;

(d) at least one securing rod between the cushion and the support sheet for securing the upholstery system to a chair frame at least at one point between the ends of the support sheet; and (e) an attachment means adapted for fastening the securing rod to the chair frame.

11. The cushioned upholstery system of claim 10 wherein the support sheet is a flexible fabric.

12. The cushioned upholstery system of claim 10 wherein the securing rod extends beyond the support sheet and upholstery fabric to directly contact the chair frame.

13. The cushioned upholstery system of claim 10 further comprising at least one strip of webbing adapted for attachment to the chair frame and positioned underneath the support sheet for providing extra support for the support sheet at the position of the webbing when the support sheet and webbing are attached to the chair frame.

14. The cushioned upholstery system of claim 10 further having buttons on the surface of the upholstery fabric with an attachment means extending from the upholstery fabric through the cushion to the securing rod, and wherein the buttons are secured to the securing rod with the attachment means.

15. The cushioned upholstery system of claim 10 wherein the ends of the support sheet are sewn into a tube shape.

16. The cushioned upholstery system of claim 10 wherein the attachment means comprises mechanical features.

17. A cushioned upholstery system adapted to be attached to a legless leisure chair frame comprising:

(a) a support sheet capable of supporting the weight of a seated occupant further having ends suitable for securing the upholstery system to the chair frame;

(b) a cushion body;

(c) an upholstery fabric sewn to the support sheet, in a manner that together the support sheet and upholstery fabric form an envelope around the cushion;

(d) at least one securing rod between the cushion and the support sheet for securing the upholstery system to a chair frame at least at one point between the ends of the support sheet; and (e) an attachment means adapted for fastening the securing rod to the chair frame.

18. The cushioned upholstery system of claim 17 wherein the support sheet is a flexible fabric.

19. The cushioned upholstery system of claim 17 wherein the securing rod extends beyond the support sheet and upholstery fabric for directly contacting the chair frame.

20. The cushioned upholstery system of claim 17 further comprising at least one strip of webbing adapted for attachment to the chair frame and positioned underneath the support sheet for providing extra support for the support sheet at the position of the webbing when the support sheet and webbing are attached to the chair frame.

21. The cushioned upholstery system of claim 17 further having buttons on the surface of the upholstery fabric with an attachment means extending from the upholstery fabric through the cushion to the securing rod, and wherein the buttons are secured to the securing rod with the attachment means.

* * * * *